US009683397B2

(12) United States Patent
Buchholz

(10) Patent No.: US 9,683,397 B2
(45) Date of Patent: Jun. 20, 2017

(54) PIVOT FITTING FOR PIECES OF FURNITURE FOR SITTING AND/OR LYING ON

(71) Applicant: Ferdinand Lusch GmbH & Co. KG, Bielefeld (DE)

(72) Inventor: Christian Buchholz, Gutersloh (DE)

(73) Assignee: Ferdinand Lusch GmbH & Co. KG, Bielefeld (DE)

( * ) Notice: Subject to any disclaimer, the term of this patent is extended or adjusted under 35 U.S.C. 154(b) by 45 days.

(21) Appl. No.: 14/889,067

(22) PCT Filed: May 5, 2014

(86) PCT No.: PCT/EP2014/059056

§ 371 (c)(1),
(2) Date: Feb. 12, 2016

(87) PCT Pub. No.: WO2014/180764

PCT Pub. Date: Nov. 13, 2014

(65) Prior Publication Data

US 2016/0153223 A1 Jun. 2, 2016

(30) Foreign Application Priority Data

May 7, 2013 (DE) ..... 10 2013 104 692

(51) Int. Cl.
*E05D 11/10* (2006.01)
*A47C 1/026* (2006.01)

(52) U.S. Cl.
CPC ..... *E05D 11/105* (2013.01); *A47C 1/026* (2013.01); *E05D 11/1007* (2013.01);
(Continued)

(58) Field of Classification Search
CPC ..... E05D 11/105; E05D 11/1007; E05D 11/1028; E05D 2011/1035;
(Continued)

(56) References Cited

U.S. PATENT DOCUMENTS 3,186,253 A * 6/1965 Ramillon ..... A47C 1/026 297/356
3,484,831 A * 12/1969 Higuchi ..... A47C 20/045 16/333
(Continued)

FOREIGN PATENT DOCUMENTS

DE 202007006758 U1 8/2007
DE 102011017301 A1 10/2012
(Continued)

*Primary Examiner* — Jeffrey O Brien
(74) *Attorney, Agent, or Firm* — The Webb Law Firm

(57) ABSTRACT

A pivot fitting having a stop lever, a ratchet lever, a blocking device and at least one toothed ring. The stop lever and the ratchet lever can be pivoted in relation to one another in an adjustment direction and in a reset direction. The stop lever and the toothed ring are coupled to one another such that pivoting of the stop lever and ratchet lever in the adjustment direction is accompanied by pivoting and/or rotation of the toothed ring in relation to the blocking device. The blocking device has at least two catches, that, in an adjustment position of the pivot fitting, the pivoting action of the stop lever and ratchet lever in the reset direction is countered by form-fitting engagement of at least one catch in the toothed ring.

15 Claims, 4 Drawing Sheets

(52) U.S. Cl.
CPC .. *E05D 11/1028* (2013.01); *E05D 2011/1035* (2013.01); *E05Y 2900/20* (2013.01); *Y10T 16/54024* (2015.01); *Y10T 16/54028* (2015.01)

(58) Field of Classification Search
CPC ..... Y10T 16/54024; Y10T 16/54026; Y10T 16/54028; Y10T 16/54029; Y10T 16/5404; Y10T 16/54044; A47C 1/026; A47C 1/0265; A47C 1/027
See application file for complete search history.

(56) References Cited

U.S. PATENT DOCUMENTS

| | | | | | |
|---|---|---|---|---|---|
| 5,211,445 | A * | 5/1993 | Husted | B60N 2/20 | 16/335 |
| 5,364,164 | A * | 11/1994 | Kuranami | A47C 7/38 | 16/334 |
| 5,397,168 | A * | 3/1995 | Hand | A47C 1/026 | 297/356 |
| 8,104,141 | B2 * | 1/2012 | Yamashita | A47C 1/026 | 16/239 |
| 8,123,710 | B2 * | 2/2012 | Chan | A61F 5/0125 | 128/882 |
| 8,156,612 | B2 * | 4/2012 | Yamashita | A47C 1/026 | 16/239 |
| 8,661,619 | B2 * | 3/2014 | Lu | A47C 17/86 | 16/321 |
| 2009/0288270 | A1 * | 11/2009 | Yamashita | A47C 1/026 | 16/239 |

FOREIGN PATENT DOCUMENTS

| | | | |
|---|---|---|---|
| EP | 1284447 | A1 | 2/2003 |
| EP | 2123194 | A1 | 11/2009 |

* cited by examiner

PIVOT FITTING FOR PIECES OF FURNITURE FOR SITTING AND/OR LYING ON

CROSS-REFERENCE TO RELATED APPLICATIONS

This application is the United States national phase of International Application No. PCT/EP2014/059056 filed May 5, 2014, and claims priority to German Patent Application No. 10 2013 104 692.4 filed May 7, 2013, the disclosures of which are hereby incorporated in their entirety by reference.

BACKGROUND OF THE INVENTION

Field of the Invention

Pivot fitting, in particular for pieces of furniture for sitting and/or lying on, having a stop lever, a ratchet lever, a blocking device and at least one toothed ring, wherein the stop lever and the ratchet lever can be pivoted in relation to one another in an adjustment direction and in a reset direction, wherein the stop lever and the toothed ring are coupled to one another such that pivoting of the stop lever and ratchet lever in the adjustment direction is accompanied by pivoting and/or rotation of the toothed ring in relation to the blocking device.

Description of Related Art

Pivot fittings of this kind are also referred to as upholstery brackets, because the pivoting fittings are regularly used for upholstered furniture. Irrespective of this, the pivot fittings of the kind mentioned are mainly used for the adjustment of headrests or arm rests of pieces of furniture for sitting and/or lying on. The pivot fittings of the kind mentioned are also referred to as locking joints, since these lock in place in at least one swivel direction and thus block. This ensures that the pivot fitting remains in certain adjustment positions even when a load is applied. Inadvertent pivoting or slackening of the pivot fitting can thus be avoided.

To connect the pivot fitting with the piece of furniture for sitting and/or lying on the former has a stop lever and a ratchet lever. Each of these levers can, for example, be connected to a headrest, wherein in each case the other lever is for example connected to a backrest. The headrest can then be pivoted into the desired position in relation to the backrest. In order that the pivot fitting is able to retain the headrest in this position, the pivot fitting has a blocking device and at least one toothed ring cooperating with the blocking device. The engagement of the blocking device in the toothed ring brings about a form fit in a pivoting direction, namely the reset direction, which should prevent an inadvertent adjustment of the pivot fitting in this direction. The stop lever and the ratchet lever can thus pivot in relation to each other in the other direction, that is to say the adjustment direction. Pivoting in the reset direction is also possible under certain conditions, if for example the blocking effect of the blocking device and toothed ring is overcome or reversed.

If the stop lever and ratchet lever are pivoted in relation to each other in the adjustment direction, then this is accompanied by a pivoting and/or rotation of the toothed ring in relation to the blocking device. Depending on the pitch of the toothed ring or the distances between the teeth, a range of adjustment positions is provided, in which the blocking device and the toothed ring create a form fit in the reset direction, thereby making pivoting in this direction accordingly impossible or in any event more difficult. A corresponding pivot fitting is known, for example, from DE 10 2011 017301 A1. In addition, from EP 1 284 447 A1 a corresponding pivoting fitting is disclosed, having two catches, upon which the invention is based.

Modern furniture for sitting and/or lying on is increasingly required to be precisely adjustable. This calls for finely graduated adjustability in the form of pivot fittings of the abovementioned type. Thus pivot fittings with a number of different adjustment positions are required. Consequently the pivot fittings, especially the toothed ring and the blocking device, are having to be of an increasingly delicate design which, however, is at the expense of the stability of the pivot fittings. The prior art pivot fittings consequently have the disadvantage that if used incorrectly they can be easily damaged.

The task of the present invention is consequently to enhance and develop the pivot fitting mentioned and described in more detail above, in such a way that precise adjustability can be combined with high stability and thus durability.

SUMMARY OF THE INVENTION

The invention has identified that the use of at least two catches allows finer adjustment of the pivot fitting, without this having to have a more delicate and thus less stable design. This is due to the fact that the at least two catches in certain settings of the pivot fitting, in particular when the stop lever and ratchet lever are pivoted in relation to each other in the adjustment direction, engage in the toothed ring to different extents. These certain positions can be the adjustment positions or certain adjustment positions. It is preferred, however, if the catches over a certain adjusting range of the pivot fitting engage to different extents in each case in the toothed ring in substantially each individual position of the pivot fitting. The extent to which the catches engage in a certain position of the pivot fitting in the toothed ring, depends on where the catches and the adjacent teeth come into contact. Adjustment of the pivot fitting in the adjustment direction changes the engagement depth of a catch. A catch preferably engages immediately after passing a tooth of the toothed ring completely or to a maximum in the toothed ring, while the catch immediately prior to passing a tooth of the toothed ring engages to a minimum in the toothed ring.

Immediately after a catch has passed a tooth of the toothed ring, the catch engages in behind the corresponding tooth. Consequently the tooth and the catch create a form fit, preventing the toothed ring from rotating in relation to the catch in the opposite direction. In this adjustment position of the pivot fitting the stop lever and the ratchet lever cannot be readily pivoted in relation to one another in the reset direction. The pivot fitting can thus be locked in each adjustment position, such that inadvertent pivoting of the pivot fitting in the reset direction is prevented.

Since the at least two catches at least in certain places in certain positions, preferably over a certain adjusting range, especially over the entire adjusting range, of the pivot fitting, engage to different extents in the toothed ring in each case, the catches pass the teeth of the toothed ring at different positions of the pivot fitting. This means that when the pivot fitting pivots in the adjustment direction a catch passes, one after the other, two successive teeth of the toothed ring and in this way defines two adjustment positions. The at least one further catch defines between these adjustment positions of the pivot fitting a further adjustment position, because the further catch, between the adjustment position defined by the one catch passes a, preferably different, tooth of the toothed ring and in doing so engages in behind this tooth in a form fit with the definition of a further adjustment position.

The adjustability of the pivot fitting is consequently not just determined by the number and spacing of the teeth of the toothed ring. If the toothed ring is rotated by one tooth in relation to a catch further in the adjustment direction, in between preferably as many further adjustment positions of the pivot fitting are created, in which a catch engages after passing the tooth of the toothed ring in a form fitting manner, as there are corresponding catches provided. The only condition here is that all catches over the corresponding pivoting range of the pivot fitting engage to different extents in the toothed ring. With two catches the pivot fitting can thus be adjusted twice as finely as with one catch. With three catches the fitting can be adjusted three times as finely as with one catch, and so on. Put another way, the number of adjustment positions can be higher by a number of times that corresponds to the number of catches. This applies in particular if the catches engage over a relevant or intended, in particular entire, pivoting range of the pivot fitting in each position of the pivot fitting, to a different extent in the toothed ring.

The design of the pivot fitting can thus provide for a toothed ring with large and broad teeth. The toothed ring can therefore absorb high forces and is thus very stable, so that damage due to incorrect use of the pivot fitting is avoided. In order nevertheless to design the pivot fitting to be very finely adjustable, and thus provide for many positions of the pivot fitting, from which the pivot fitting cannot already be readily pivoted in the reset direction (adjustment positions), a plurality of catches is provided, wherein each of these catches is preferably of sufficiently solid design to be able to similarly absorb high forces, in order in this way to avoid damage to the catches.

In a first preferred embodiment of the pivot fitting, the at least two catches are provided such that upon pivoting of the stop lever and ratchet lever in the adjustment direction at substantially regular angular distances an adjustment position of the pivot fitting is provided. Thus the adjustment positions can be evenly distributed over the adjusting range of the pivot fitting, which is particularly convenient. For example, with two catches, the second catch can define an adjustment position precisely in the middle of the adjustment range or adjustment angle between two adjustment positions defined by the first catch. With three or more catches the corresponding adjustment range or adjustment angle can be divided up through two or more adjustment positions into three or more sections of substantially the same size.

Alternatively or in addition, the at least two catches can be provided such that upon pivoting of the stop lever and ratchet lever in the adjustment direction between two consecutive adjustment positions defined by a catch the at least one further catch defines an adjustment position. In this way a high number of adjustment positions can be provided, improving the convenience of adjusting the pivot fitting. More preferably, all further catches between the successive adjustment positions defined by the first catch in each case define a further adjustment position.

Alternatively or in addition, the at least two catches can also be provided such that upon pivoting of the stop lever and ratchet lever in the adjustment direction the individual adjustment positions are spaced apart by substantially the same pivot angle. The adjustment positions can then distribute themselves substantially evenly, preferably over the entire adjusting range of the pivot fitting.

It is particularly functional and structurally simple, if the at least two catches are spring-loaded in the direction of the toothed ring. The catches can then always be in contact with at least one tooth of the toothed ring and engage in the toothed ring to the extent allowed by the contact between catch and associated tooth. This also ensures that the catches, after passing a tooth, immediately engage in behind this, in order to provide a form fit and thus an adjustment position. The restoring force of the corresponding spring means can ensure that the catch engages in the adjustment position as far as possible in the toothed ring. Irrespective of this, to ensure the functioning of the catches, it is preferred if a spring means is assigned to each catch.

To be able to provide the greatest possible adjusting range of the pivot fitting and/or allow highly flexible selection of the adjusting range, the at least one toothed ring can take the form of a toothed washer with circumferentially arranged teeth. Thus the toothed ring has no ends, but the teeth run continuously around the toothed ring.

The stability of the pivot fitting can be further increased through a better force distribution, which avoids load peaks, if two or more toothed rings are provided. From the design point of view, then, it is also appropriate if the at least two catches are provided such that, upon pivoting of the stop lever and ratchet lever in the adjustment direction, in each case they engage simultaneously in at least two toothed rings, preferably all toothed rings.

In a further preferred pivot fitting it is provided that, under the blocking engagement of at least one catch and the toothed ring, the stop lever and the ratchet lever can be pivoted in the reset direction and/or the stop lever can be pivoted relative to the toothed ring in the reset direction. In this way a ratchet clamping joint can be provided. When adjusting the pivot fitting in the reset direction initially the form fit between a catch and the toothed ring counteracts this adjustment. Since, however, the toothed ring and the stop lever are connected together not in a fixed way but preferably by friction through clamping forces, with sufficient application of force an adjustment in the reset direction can be achieved. This occurs if the static friction between the stop lever and the toothed ring is overcome. Since with such a ratchet clamping joint the catches and the toothed ring as required are only moved unidirectionally in relation to one another, it is appropriate if the toothed ring takes the form of a toothed washer. In this way no end position is reached and the pivot fitting can always be further adjusted.

In particular for a structurally simple and at the same time functional development of a pivot fitting the stop lever can be held by friction relative to the toothed ring. Here the frictional force can be set by selection of the friction surfaces, the materials and the clamping forces. This allows the limiting force for overcoming the adhesive friction, beyond which the pivot fitting, despite the blocking engagement of catch and toothed ring, can be adjusted in the reset direction, to be set in advance.

For setting the defined clamping force between the stop lever and the toothed ring, wherein between the stop lever and the toothed ring further components can be provided, a clamping device can be provided. In a particularly simple pivot fitting the clamping device is designed as a clamping screw.

For adjusting the coefficient of friction, acting between the stop lever and the at least one toothed ring, between the stop lever and the at least one toothed ring a clamping washer can be provided. The clamping washer preferably has a high coefficient of friction, in order that even at moderate clamping forces high friction between the stop lever and the at least one toothed ring can be achieved.

The pivot fitting can alternatively also be designed as a pure catch fitting, so that the stop lever in relation to the ratchet lever under the blocking engagement of a catch and the toothed ring cannot be pivoted without damage in the reset direction. In order to enable pivoting of the stop lever in relation to the ratchet lever in the reset direction, initially then the blocking engagement of catch and toothed ring must be removed. This can be achieved automatically by pivoting the pivot fitting initially as far as an end position in the adjustment direction. For this various devices are known from the state of the art, which can basically be used on the present pivot fitting. It can therefore basically be provided that the stop lever and the ratchet lever without engagement between at least one catch and the toothed ring can be pivoted in relation to one another in the reset direction. This ability to pivot in the direction of the reset direction preferably exists starting from an end position and/or as far as an end position of the pivot fitting.

BRIEF DESCRIPTION OF THE DRAWINGS

The invention is explained in more detail below using a drawing showing a mere embodiment. The drawing shows as follows.

DETAILED DESCRIPTION OF THE INVENTION

Figure 1:
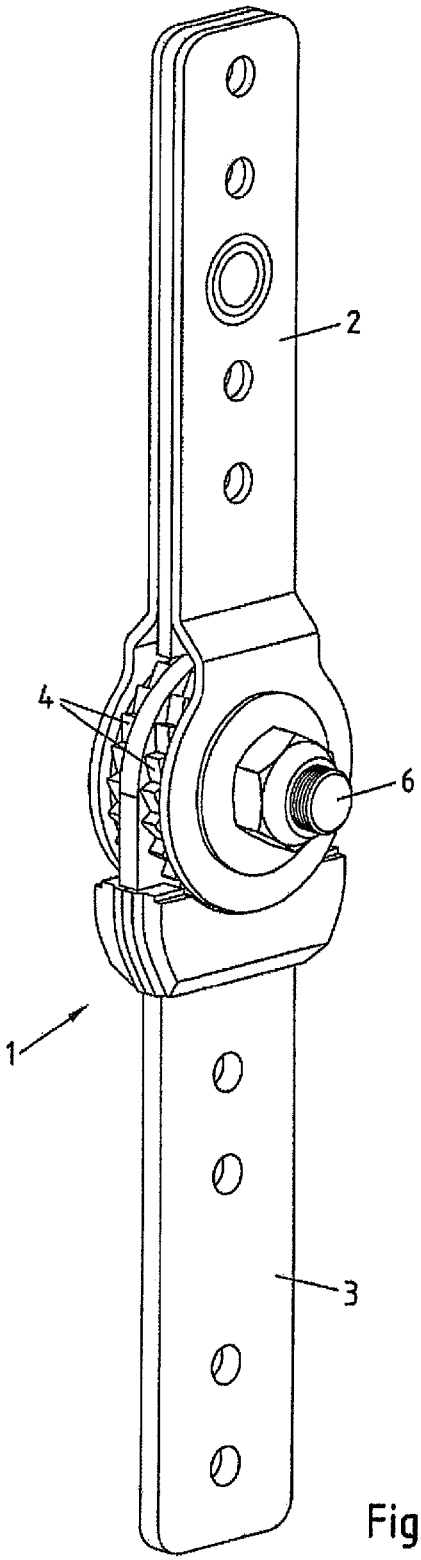
FIG. 1 a first pivot fitting according to the invention in a perspective view, FIG. 2 a sectional view showing the pivot fitting from FIG. 1 in detail, FIG. 3 an exploded view of the pivot fitting from FIG. 1, FIG. 4 a second pivot fitting according to the invention in a perspective view, FIG. 5 a sectional view showing the pivot fitting from FIG. 4 in detail and FIG. 6 an exploded view of the pivot fitting from FIG. 4.

FIG. 1 shows a pivot fitting 1 in the form of a ratchet clamping joint for upholstered furniture with a stop lever 2 and a ratchet lever 3. The stop lever 2 and the ratchet lever 3 can be connected with various components of a piece of furniture for sitting or lying on, for example a headrest and a backrest or an armrest and a seat. In this way the one component, for example the headrest or the armrest, can be pivoted in relation to the other component, for example the backrest or the seat. Thus the piece of furniture for sitting or lying on can be pivoted into a comfortable position for the user.

The pivot fitting 1 can be pivoted in two opposing directions. Thus the stop lever 2 can be pivoted in relation to the ratchet lever 3 in an adjustment direction E and a reset direction R. In the adjustment direction E the pivot fitting 1 can be quite easily adjusted, until the pivot fitting 1 has reached the desired position. As, in particular, shown in FIGS. 1 and 2, during pivoting in the adjustment direction E two toothed rings 4 in the form of toothed washers are rotated in relation to a blocking device 5. Here the toothed rings 4 are retained in a rotating manner on a clamping screw 6. The blocking device 5 comprises two catches 7,7', which through separate spring means 8 are spring-loaded in the direction of the toothed rings 4 and retained in a substantially pivotable manner in seats 9 of the ratchet lever 3. The spring means 8 thus exert on the catches 7,7' a restoring force, which pushes the catches 7,7' against the toothed rings 4. The catches 7,7' are furthermore accommodated and held in separate seats 9 of the ratchet lever 3, such that the toothed rings 4 upon pivoting of the pivot fitting 1 in the adjustment direction E can slide on the catches 7,7' without form-fitting engagement. Here the catches 7,7' pass the toothed rings 4 tooth by tooth and in doing so slide onto at least one flank of the teeth 10.

In each position of the pivot fitting 1 shown, and to that extent preferred, the two catches 7,7' engage to different extents in the toothed rings 4. For the sake of clarity, this is described below using FIG. 2 and just one toothed ring 4, the more so as use of two or more toothed rings 4 is not mandatory, but just optional. In the position shown in FIG. 2 of the pivot fitting 1, the right catch 7 has just passed a tooth 10 of the toothed ring 4 and is engaging to the maximum in the gap between this tooth 10 and the next tooth 10. In doing so, the catch 7 creates a form-fit with the tooth 10 it has just passed in the opposite direction, wherein the catch 7 comes up against on the one hand a flank of the tooth 10 just passed, and the seat 9 in the ratchet lever 3. In this way the catch 7 blocks the further rotation of the toothed ring 4 in one direction of rotation.

The left catch 7' engages only slightly in the toothed ring 4 and in this position does not create a form fit with the toothed ring 4. It is therefore only the right catch 7, and not the left catch 7', that is active in blocking the toothed ring 4.

It would be different, however, if the toothed ring 4 were rotated further, by an angle of rotation that is smaller than the angular range defined by the width of a tooth 10 of the toothed ring 4; then the rotation of the toothed ring 4 in the opposite direction would result in a form-fitting engagement of the left catch 7', as described above for the right catch 7. Here the right catch 7 would then be inactive in terms of the blocking of a further rotation of the toothed ring 4.

Each of the positions, in which a form fit between a catch 7,7' and the toothed ring 4 exists, represents an adjustment position, in which the pivot fitting 1 can be adjusted by pivoting the adjustment direction E and in which the pivot fitting 1 prevents an inadvertent resetting. As a result of the two catches 7,7', despite relatively broader and larger teeth 10 of the toothed ring 4, a larger number of adjustment positions can be provided. Therefore the toothed ring 4 does not have to be further rotated relative to the blocking device 5 by a whole tooth, in order to reach the next adjustment position, only by an angular range corresponding to half a tooth 10.

Figure 2:
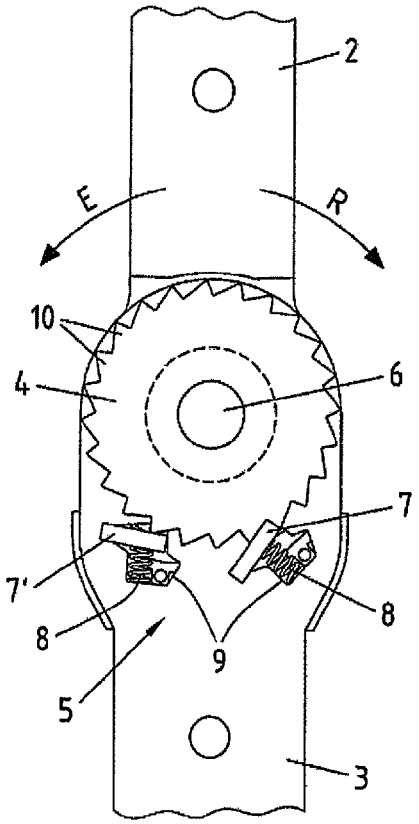
Figure 3:
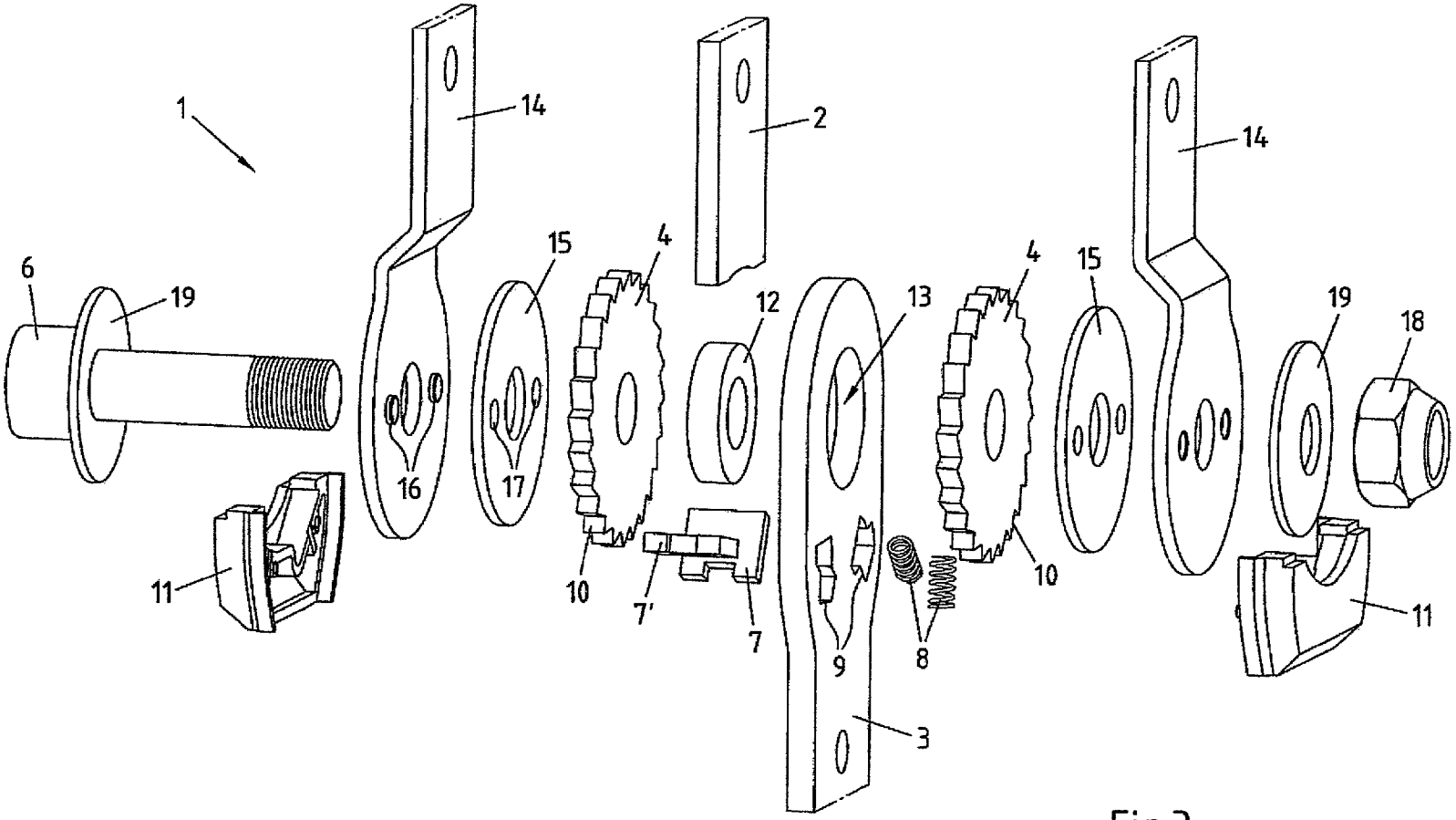

From a purely functional point of view, the pivot fitting 1 shown in FIGS. 1 to 3 offers the same adjustment possibilities as a pivot fitting with just one catch having a toothed ring with twice as many teeth but with half the size. Here the number of adjustment positions could be further increased if further catches were to be provided such that these in the specific positions, in each case in comparison with all other catches, engage to different extents in the toothed ring.

As shown in particular in FIG. 3, the pivot fitting 1 shown in FIGS. 1 to 3 is a ratchet clamping fitting. The pivot fitting 1 can therefore, despite the blocking engagement of catch 7,7' and toothed rings 4, be pivoted in the reset direction R, provided sufficient force is applied. That is to say that, the stop lever 2 and the toothed rings 4 are merely held together by friction. If the force applied to the pivot fitting 1 in the reset direction R is sufficiently great, the adhesive friction between the stop lever 2 and the toothed rings 4 is overcome. Then the stop lever 2 is pivoted in relation to the ratchet lever 3 and in relation to the toothed rings 4 in the reset direction R, while the toothed ring 4 and a catch 7,7' remain in blocking form-fitting engagement.

Between the toothed rings 4 the ratchet lever 3 is arranged, having two seats 9 to accommodate the two catches 7,7' and the two spring means 8, which position the catches 7,7' as a result of their restoring force against the toothed rings 4. The catches 7,7' are designed such that the catches 7,7' in each case simultaneously engage in both toothed rings 4 on both sides of the ratchet lever 3. To this end the catches 7,7' protrude sufficiently far on both sides beyond the ratchet lever 3. In order to externally protect the catches 7,7', on each side of the pivot fitting 1 a cover 11 is provided.

In the ratchet lever 3 a free-running bushing 12 is further provided, which in order to reduce jamming between the toothed rings 4 and the ratchet lever 3 has a broader design than the ratchet lever 3 itself. To further reduce the friction between the free-running bushing 12 and the ratchet lever 3 the external diameter of the free-running bushing 12 is smaller than the internal diameter of the opening 13 of the ratchet lever 3 accommodating the free-running bushing 12.

The stop lever 2 encompasses the toothed washers 4 on their external sides with the help of clamping levers 14, wherein between the clamping levers 14 and the toothed rings 4 clamping discs 15 with high coefficients of friction are provided. In so doing, the clamping discs 15 are secured against rotation through protrusions 16 and corresponding openings 17 on the clamping levers 14. In order to be able to provide sufficient frictional force, preventing inadvertent pivoting of the pivot lever 1 in the reset direction R, the clamping discs 15 are pressed on the toothed rings 4 namely as a result of a clamping force applied by a clamping screw 6. The clamping screw 6 is pushed through from one side of the pivot fitting 1 and tightened from the other side of pivot fitting 1 with a nut 18. In the process the longitudinal axis of the clamping screw 6 also forms the pivot axis for the stop lever 2 and/or the ratchet lever 3 when adjusting the pivot lever 1. In addition, adjacent to the nut 18 and the screw head of the clamping screw 6 clamping washers 19 are provided.

Figure 4:
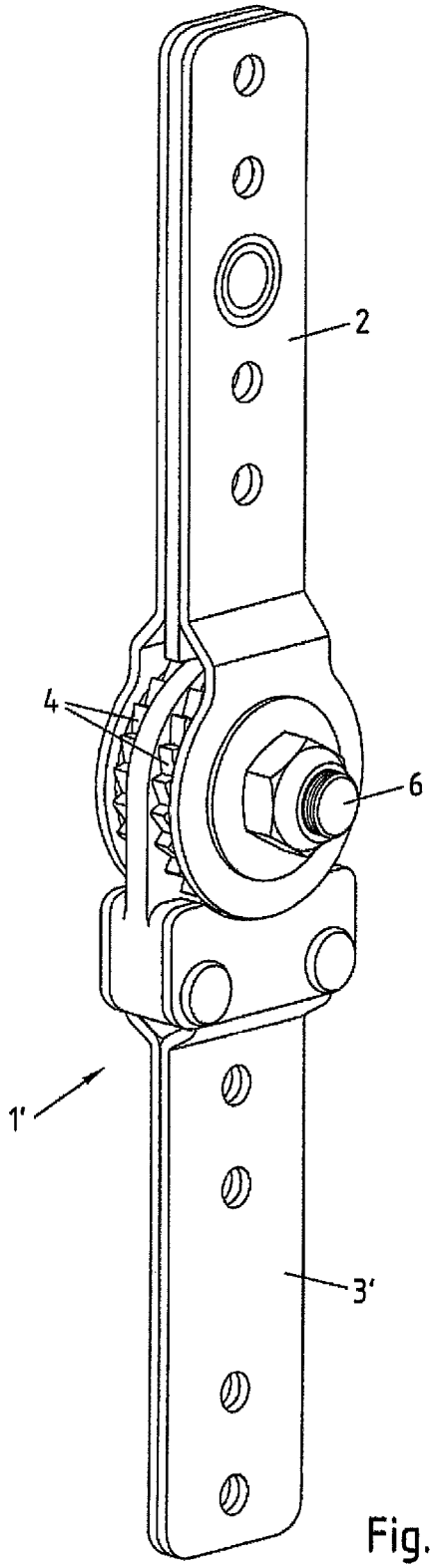
Figure 5:
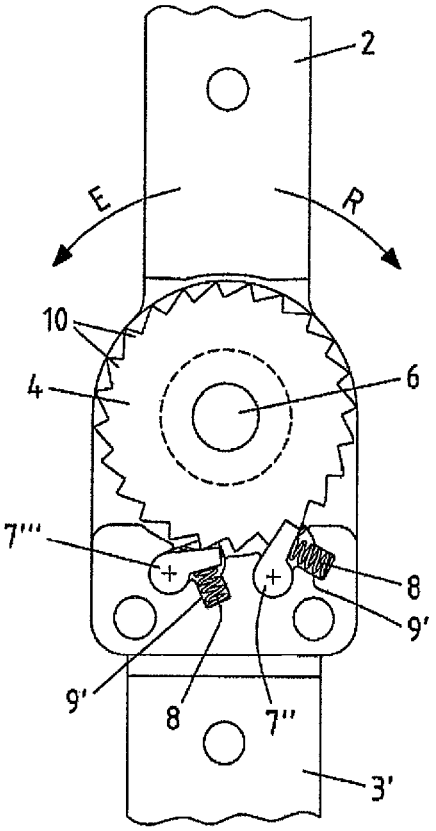
Figure 6:
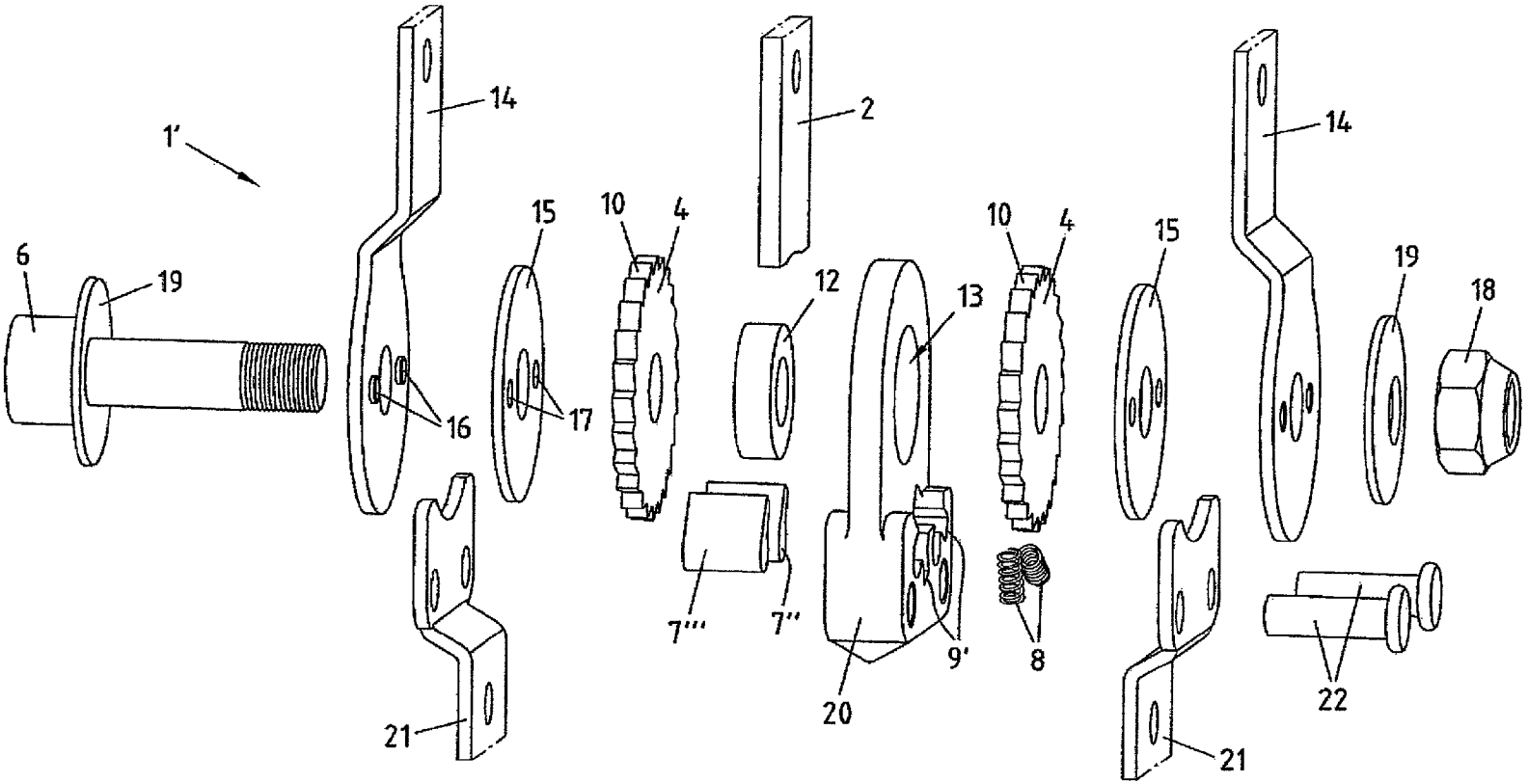

FIGS. 4 to 6 show a pivot fitting 1' likewise in the form of a ratchet clamping joint, which is structurally and functionally very similar to the pivot fitting shown in FIGS. 1 to 3. Therefore, for both pivot fittings 1,1' the same references are used. In addition, in the following only the differences between the pivot fitting 1' according to FIGS. 4 to 6 and the pivot fitting 1 according to FIGS. 1 to 3 are considered. This difference is for example that the ratchet lever 3' has a multi-part design and a catch carrier 20. Here the catches 7",7''' are fully accommodated in seats 9' of the catch carrier 20. The catches 7",7''' do not therefore protrude outwards beyond the catch carrier 20. Outwardly the seats 9' for the catches 7",7''' are closed off by two free running levers 21, secured via connecting bolts 22 to the catch carrier 20. Here the free running levers 21 and the catch carrier 20 together form the ratchet lever 3'.

A further difference between the pivot fitting 1' according to FIGS. 4 to 6 and the pivot fitting 1 according to FIGS. 1 to 3 is that the ends of the catches 7",7''' inserted into the seats 9' of the catch carrier 20 are rounded. The seats 9' of the catch carrier 20 are similarly rounded at the corresponding point, namely in correspondence with the roundings of the catches 7",7'''.

The invention claimed is:

1. A pivot fitting having a stop lever, a ratchet lever, a blocking device and at least one toothed ring, wherein the stop lever and the ratchet lever can be pivoted in relation to one another in an adjustment direction and in a reset direction, wherein the stop lever and the toothed ring are coupled to one another such that pivoting of the stop lever and ratchet lever in the adjustment direction is accompanied by pivoting and/or rotation of the toothed ring in relation to the blocking device, wherein the blocking device has at least two catches which engage in the toothed ring in a plurality of adjustment positions, and wherein in each adjustment position of the pivot fitting the pivoting of the stop lever and ratchet lever in the reset direction is counteracted by the form-fitting engagement of at least one catch in the toothed ring, wherein each of the at least two catches in each adjustment position of the pivot fitting engage in the toothed ring to different extents.

2. The pivot fitting according to claim 1, wherein the at least two catches are provided such that upon pivoting of the stop lever and ratchet lever in the adjustment direction at substantially regular angular distances each adjustment position of the pivot fitting is provided.

3. The pivot fitting according to claim 1, wherein upon pivoting of the stop lever and ratchet lever in the adjustment direction between two consecutive adjustment positions defined by one of the at least two catches a second of the at least two catches defines another adjustment position.

4. The pivot fitting according to claim 1, wherein the at least two catches are provided such that upon pivoting of the stop lever and ratchet lever in the adjustment direction each adjustment position is spaced apart by a substantially equal pivot angle of the pivot fitting.

5. The pivot fitting according to claim 1, wherein the at least two catches are spring-loaded in the direction of the at least one toothed ring.

6. The pivot fitting according to claim 1, wherein the at least one toothed ring takes the form of a toothed washer with circumferentially arranged teeth.

7. The pivot fitting according to claim 1, wherein the at least two catches are provided such that, upon pivoting of the stop lever and ratchet lever in the adjustment direction, each of the at least two catches engage in at least two toothed rings.

8. The pivot fitting according to claim 1, wherein the stop lever is held by friction relative to the at least one toothed ring, and wherein under a blocking engagement of at least one catch and the at least one toothed ring, the stop lever and the ratchet lever can be pivoted in the reset direction.

9. The pivot fitting according to claim 1, wherein the stop lever is held by friction relative to the at least one toothed ring, and wherein under a blocking engagement of at least one catch and the at least one toothed ring, the stop lever can be pivoted relative to the toothed ring in the reset direction.

10. The pivot fitting according to claim 1, wherein the stop lever is held by friction relative to the at least one toothed ring.

11. The pivot fitting according to claim 1, wherein a clamping device is provided for application of a clamping force between the stop lever and the at least one toothed ring.

12. The pivot fitting according to claim 1, wherein between the stop lever and the at least one toothed ring a clamping washer is provided.

13. The pivot fitting according to claim 1, wherein the stop lever and the ratchet lever, can be pivoted without engagement between the at least two catches and the at least one toothed ring in the reset direction.

14. The pivot fitting according to claim 11, wherein the clamping device is a clamping screw.

15. The pivot fitting according to claim 13, wherein the stop lever and the ratchet lever can be pivoted from a first end position without engagement between the at least two catches and the at least one toothed ring in the reset direction into a second end position.

* * * * *